US011344169B2

(12) United States Patent
Belville et al.

(10) Patent No.: US 11,344,169 B2
(45) Date of Patent: May 31, 2022

(54) VACUUM ASSEMBLIES AND METHODS

(71) Applicant: Rexair LLC, Troy, MI (US)

(72) Inventors: Alan Belville, Leroy, MI (US); Mark Howie, Cadillac, MI (US); Thomas L. Carrington, McBain, MI (US); James D. Jakubos, Cadillac, MI (US)

(73) Assignee: REXAIR LLC, Troy, MI (US)

( * ) Notice: Subject to any disclaimer, the term of this patent is extended or adjusted under 35 U.S.C. 154(b) by 0 days.

(21) Appl. No.: 16/593,715

(22) Filed: Oct. 4, 2019

(65) Prior Publication Data

US 2020/0107687 A1 Apr. 9, 2020

Related U.S. Application Data

(60) Provisional application No. 62/741,312, filed on Oct. 4, 2018.

(51) Int. Cl.
*A47L 9/18* (2006.01)
*A47L 9/24* (2006.01)

(52) U.S. Cl.
CPC ..... *A47L 9/246* (2013.01); *A47L 9/181* (2013.01); *A47L 9/248* (2013.01)

(58) Field of Classification Search
CPC . A47L 5/362; A47L 9/18; A47L 9/181; A47L 9/246; A47L 9/248
USPC ..... 15/320, 327.1, 353
See application file for complete search history.

(56) References Cited

U.S. PATENT DOCUMENTS 2,974,343 A * 3/1961 Seyfried ..... A47L 9/26 15/323
3,034,085 A 5/1962 Pauler et al.
3,177,635 A * 4/1965 Cawl ..... A47L 9/1427 96/421
4,316,304 A 2/1982 Parise et al.
4,463,474 A * 8/1984 Jacobs ..... A47L 7/0042 15/353
4,618,195 A 10/1986 Keane
5,022,115 A * 6/1991 Kasper ..... A47L 9/18 15/353

(Continued)

FOREIGN PATENT DOCUMENTS

DE 102005018288 A1 * 10/2006 ..... A47L 5/365
DE 102005018288 A1 10/2006

(Continued)

OTHER PUBLICATIONS

International Search Report and Written Opinion dated Mar. 19, 2020 in PCT Application No. PCT/US2019/054809.

(Continued)

*Primary Examiner* — Joseph J Hail
*Assistant Examiner* — Arman Milanian
(74) *Attorney, Agent, or Firm* — McDermott Will & Emery LLP

(57) ABSTRACT

Vacuums including a water pan mount coupled to a housing and configured to receive a water pan are provided herein. The housing is operably rotatable around a fulcrum, relative to the water pan mount, to secure the water pan within the housing. At least one latch is coupled to the housing and is operably positionable in an engaged position and in a disengaged position, wherein, in the engaged position, the at least one latch prevents rotation of the housing around the fulcrum.

20 Claims, 22 Drawing Sheets

(56) References Cited

U.S. PATENT DOCUMENTS

| | | | | |
|---|---|---|---|---|
| 5,339,487 | A * | 8/1994 | Kasper | A47L 9/18 15/246.2 |
| 5,958,113 | A | 9/1999 | Collins et al. | |
| 6,256,834 | B1 * | 7/2001 | Meijer | A47L 9/1427 15/352 |
| 2015/0135474 | A1 | 5/2015 | Gidwell | |

FOREIGN PATENT DOCUMENTS

| | | | | |
|---|---|---|---|---|
| DE | 102015016336 | A1 * | 6/2017 | A47L 9/181 |
| DE | 102015016336 | A1 | 6/2017 | |
| EP | 2676593 | A1 | 12/2013 | |

OTHER PUBLICATIONS

Invitation to Pay Additional Fees and, Where Applicable, Protest Fee dated Jan. 20, 2020 in PCT Application No. PCT/US2019/054809.
Office Action dated Mar. 11, 2020 in U.S. Appl. No. 16/593,712.
Office Action dated Sep. 14, 2020 in U.S. Appl. No. 16/593,712.
Office Action dated May 19, 2021 in U.S. Appl. No. 16/593,712.
Notice of Allowance dated Sep. 16, 2021 in U.S. Appl. No. 16/593,712.

* cited by examiner

VACUUM ASSEMBLIES AND METHODS

CROSS-REFERENCE TO RELATED APPLICATIONS

The present application claims the benefit of priority under 35 U.S.C. § 119 from U.S. Provisional Patent Application Ser. No. 62/741,312 entitled "VACUUM ASSEMBLIES AND METHODS," filed on Oct. 4, 2018, the disclosure of which is hereby incorporated by reference in its entirety for all purposes.

FIELD OF THE DISCLOSURE

The present application relates generally to vacuum cleaners, and more particularly to vacuum cleaners having an actuating lift for removing a removable water pan and/or a wand assembly with electrical contacts.

BACKGROUND

Water filter vacuums vary from traditional air filter vacuums by pulling debris through a reservoir of water instead of a cyclonic or paper/cloth air filter. For example, water filter vacuums send the matter coming into the vacuum through the interior reservoir of water to trap dirt, debris, and odors from the air. Over time, as the water filter vacuum is used, the water within the interior reservoir becomes dirty and needs to be replaced with fresh water. The water filter vacuum housing stores the interior reservoir inside a cover that must be unlatched, lifted, and set aside to remove the interior reservoir. Accordingly, there exists a need for improved interior water reservoir removal and cleaning.

Wand assemblies, or hollow rigid tubes attached to one end of a vacuum hose, are typically simple pieces of plastic or metal of various sizes and shapes. Some wand assemblies, however, include an electric connection extending along the body of the wand. The electric connection may be necessary for certain vacuum attachments such as brushes or other cleaning tools. Oftentimes, the cyclic process of pushing and pulling the powered accessory back and forth will provide enough mechanical resistance to create relative motion between the electrical terminal connections within the wands. This repeated motion can wear the components rather quickly. Therefore, there exists a need for improving the wand assembly to withstand an increased number of cycles.

SUMMARY

According to certain aspects of the present disclosure, a vacuum is provided. The vacuum includes a housing. A water pan mount is coupled to the housing and configured to receive a water pan, wherein the housing is operably rotatable around a fulcrum, relative to the water pan mount, to secure the water pan within the housing. At least one latch is coupled to the housing. The at least one latch is operably positionable in an engaged position and in a disengaged position, wherein, in the engaged position, the at least one latch prevents rotation of the housing around the fulcrum.

According to certain implementations of the present disclosure, the vacuum further comprises a series of biasing members coupled to the housing and the water pan mount, wherein the series of biasing members are configured to apply rotational force to the housing about the fulcrum.

According to certain implementations of the present disclosure, the series of biasing members comprise one of at least two gas lift springs, a set of compression springs, a set of extension springs, a set of torsion springs, a set of tension springs wherein each tension spring is operably coupled to opposed bars, and a constant force spring.

According to certain implementations of the present disclosure, the housing and the water pan each comprise at least two apertures configured to operably align to create a path for airflow.

According to certain implementations of the present disclosure, the fulcrum comprises an axle.

According to certain implementations of the present disclosure, the at least one latch comprises two latches configured to secure the housing to the water pan mount.

According to certain implementations of the present disclosure, the housing comprises a canister comprising an internal volume configured to contain vacuum components.

According to certain implementations of the present disclosure, the water pan comprises a set of handles configured to engage housing.

According to certain implementations of the present disclosure, the at least one latch is coupled to the water pan in the engaged position.

According to certain implementations of the present disclosure, the at least one latch is operably coupled to the set of handles in the engaged position.

According to certain implementations of the present disclosure, in the engaged position, the at least one latch is coupled to the water pan mount.

According to certain aspects of the present disclosure, a vacuum is provided. The vacuum includes a housing. A water pan mount is rotably coupled to the housing around a fulcrum and contoured to complementarily receive a water pan. At least one biasing member couples the housing to the water pan mount. The at least one biasing member is configured to apply rotational force to the housing about the fulcrum. At least one latch is disposed on one of the housing and the water pan mount. The at least one latch is operably positionable in an engaged position and in a disengaged position, wherein, in the engaged position, the at least one latch prevents rotation of the housing with respect to the water pan mount.

According to certain implementations of the present disclosure, in the disengaged position, the housing is rotatable around the fulcrum.

According to certain implementations of the present disclosure, the at least one biasing member is configured to apply rotational force to the housing about the fulcrum.

According to certain aspects of the present disclosure, a vacuum is provided. The vacuum includes a hollow wand including a distal end. A vacuum accessory includes a proximal end. The vacuum accessory is configured to releasably couple with the hollow wand. A first terminal is disposed at the distal end of the hollow wand. A second terminal is disposed at the proximal end of the vacuum accessory. The second terminal is configured to correspondingly electrically mate with the first terminal. A biasing member is operably coupled to one of the first terminal and the second terminal, wherein, when the hollow wand is releasably coupled to the vacuum accessory, the biasing member is compressed such that the first terminal and the second terminal are maintained in mating contact with each other.

According to certain implementations of the present disclosure, when the hollow wand is releasably coupled to the vacuum accessory, relative positions of the first terminal and the second terminal are maintained in mating contact with each other, and refrain from sliding movement against each other, despite movement between the hollow wand and the vacuum accessory.

According to certain implementations of the present disclosure, the biasing member is one of a compression spring, a tension spring, a constant force spring, and an extension spring.

According to certain implementations of the present disclosure, the vacuum further includes a second biasing member operably coupled to the other one of the first terminal and the second terminal.

According to certain implementations of the present disclosure, the first terminal is a male terminal.

According to certain implementations of the present disclosure, the first terminal comprises one of a pin terminal, a flat terminal, and a straight blade plug.

According to certain implementations of the present disclosure, the second terminal is a female terminal.

According to certain implementations of the present disclosure, the second terminal is one of a receptacle barrel terminal, a flat terminal, and a straight blade connector.

According to certain implementations of the present disclosure, the vacuum further includes a sleeve mechanically coupled to the hollow wand, wherein the first terminal is partially disposed within the sleeve between the hollow wand and the sleeve.

According to certain implementations of the present disclosure, the sleeve comprises an elongated neck, a first apertural band and a second apertural band, wherein the first apertural band and the second apertural band are configured to secure the sleeve to the hollow wand.

According to certain implementations of the present disclosure, the vacuum further includes a button lock operably coupled to the sleeve, wherein the button lock is selectively actuatable between an engaged position and a disengaged position. The button lock is configured to, in the engaged position, secure the first terminal to the second terminal when the hollow wand is releasably coupled to the vacuum accessory.

According to certain implementations of the present disclosure, the button lock is configured to releasably disengage the first terminal from the second terminal when the button lock is selectively actuated from the engaged position to the disengaged position.

According to certain aspects of the present disclosure, a vacuum is provided. The vacuum includes a hollow wand including a distal end. The hollow wand is configured to releasably couple with a vacuum accessory. A first terminal is disposed at the distal end of the hollow wand. A biasing member operably is coupled to the first terminal, wherein, when the hollow wand is releasably coupled to the vacuum accessory, the biasing member is compressed such that the first terminal is maintained in mating electrical contact with a second terminal of the vacuum accessory.

According to certain aspects of the present disclosure, a vacuum accessory is provided. The vacuum accessory includes a vacuum accessory end configured to releasably couple with a hollow wand. A first terminal disposed at the vacuum accessory end. A biasing member is operably coupled to the first terminal, wherein, when the vacuum accessory end is releasably coupled to the hollow wand, the biasing member is compressed such that the first terminal and a second terminal of the hollow wand are maintained in electrical mating contact with each other.

The subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

Referring now to the drawings, which are meant to be exemplary and not limiting, and wherein like elements are numbered alike. The detailed description is set forth with reference to the accompanying drawings illustrating examples of the disclosure, in which use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION

Vacuums including a self-actuating lift and/or a vacuum wand assembly, and methods of using the same are provided herein. For example, the vacuums may be water filter-type vacuums or other suitable vacuums.

Self-Actuating Lift Mechanisms

Figure 1:
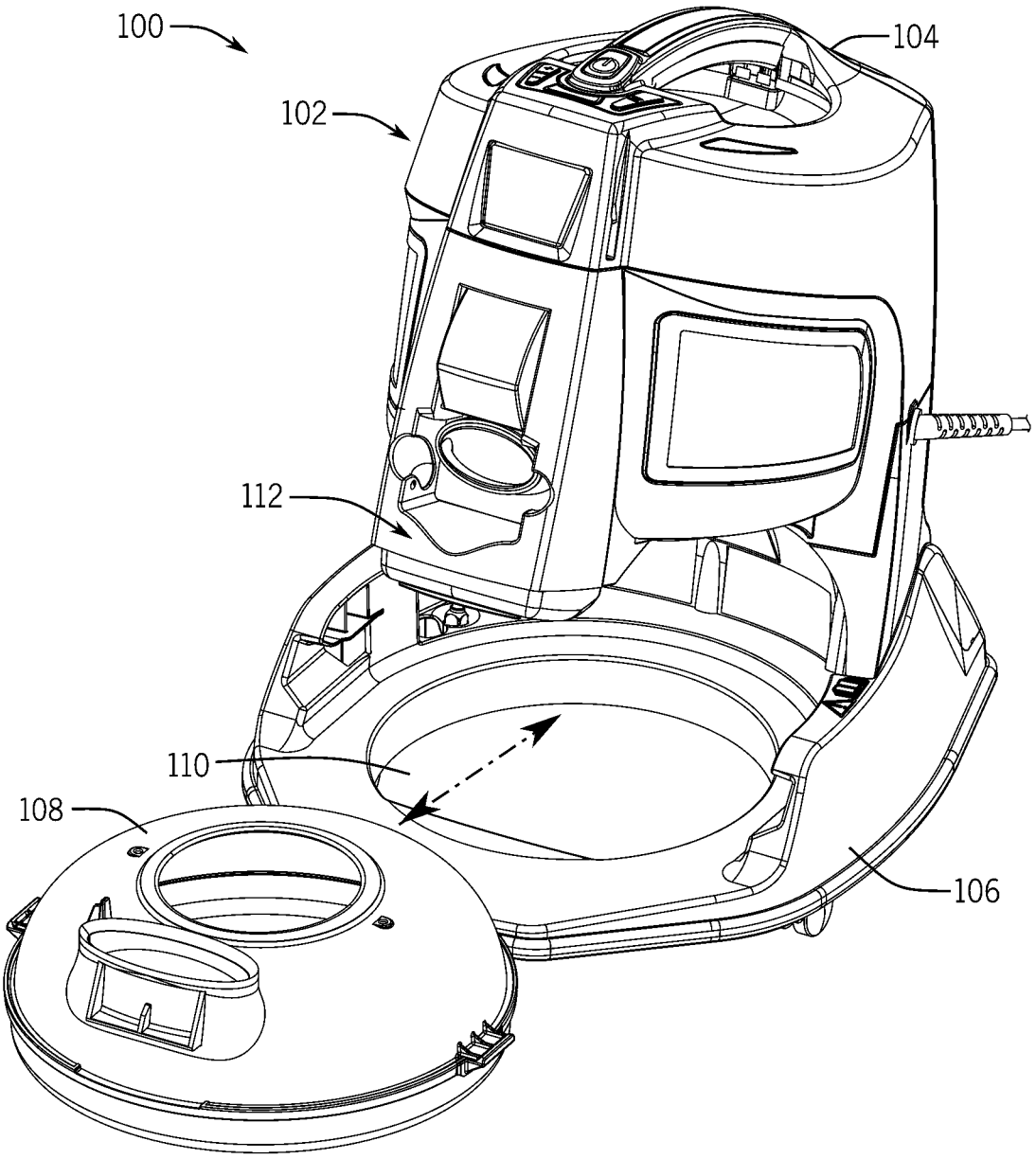
FIG. 1 is a front perspective view of one embodiment of a vacuum with a self-actuating lift.
Figure 2:
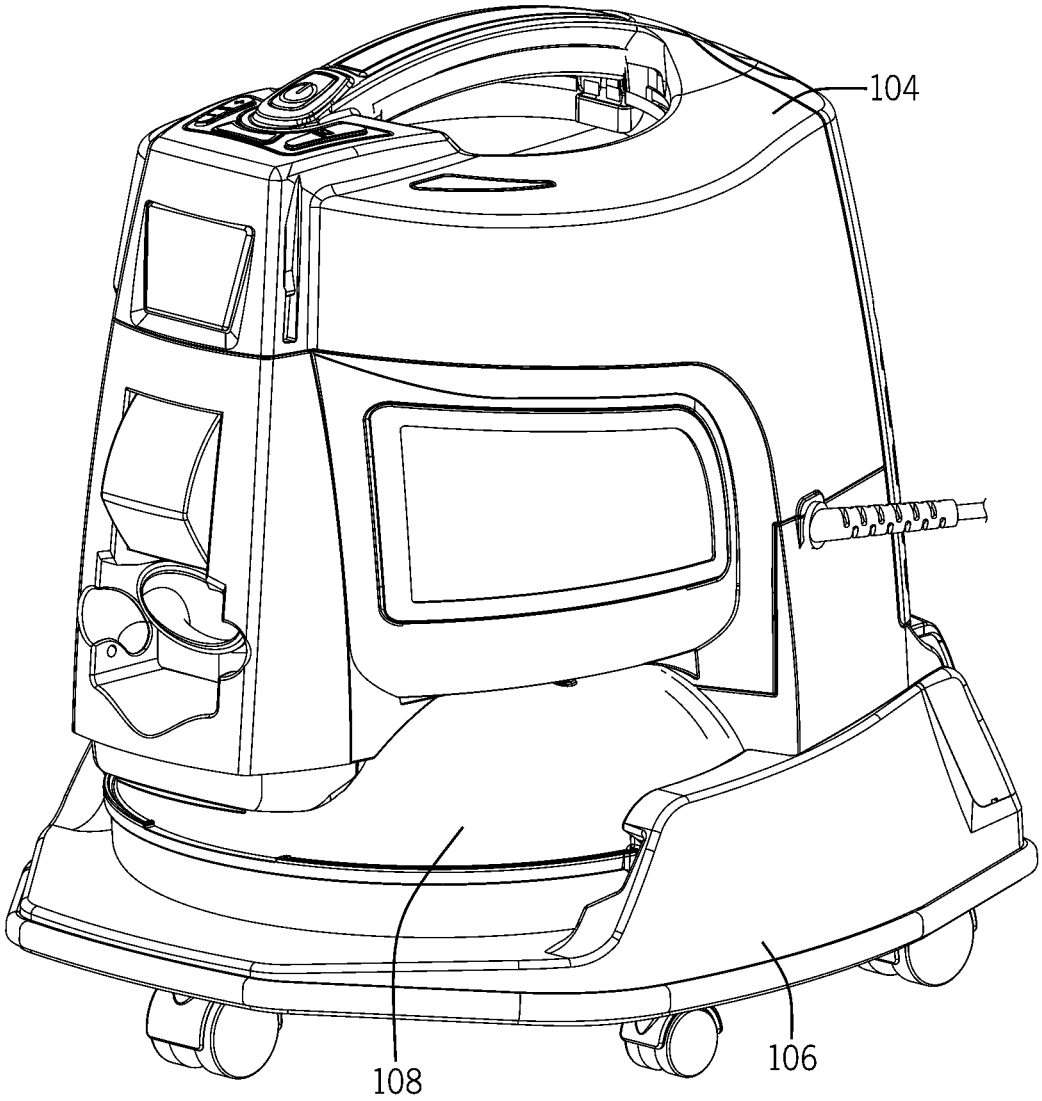
FIG. 2 is a partial side view of the vacuum of FIG. 1.

In some embodiments, as shown in FIG. 1, a vacuum includes a housing and a water pan mount. In some embodiments, the water pan mount is coupled to the housing and configured to receive a water pan, such as are known for use in water filter-type vacuums. In some embodiments, the housing is operably rotatable around a fulcrum, relative to the water pan mount, to secure the water pan within the housing. In some embodiments, the vacuum includes at least one latch coupled to the housing, with the at least one latch being operably positionable in an engaged position and a disengaged position. In some embodiments, the latch in an engaged position prevents operable rotation of the housing around the fulcrum.

In some embodiments, as shown in FIGS. 4A-4E and 14-17, the vacuum 100 includes a series of biasing members 114 coupled to the housing 102 and the water pan mount 106. The biasing members 114 may be configured to rotate the housing 102 around the fulcrum point 116. For example, the biasing members 114 may include one or more gas lift springs configured to exert a normal force on the housing 102. For example, the gas lift springs may use compressed gas within an enclosed cylinder to exert an opposite force on an external force applied parallel to the direction of the piston (not shown). In some instances, the biasing members 114 may be another type of spring, such as a compression spring, an extension spring, a torsion spring 126 (see FIG. 17), a tension spring 120 operably coupled to opposing bars 122 (see FIGS. 14-15), a gas spring 124 operably coupled to a strut 125 (see FIG. 16), or a constant force spring configured to rotate the canister 104 around a fulcrum point 116. For example, after the latch 112 is disengaged, the biasing members 114 may begin to lift the canister 104 around the fulcrum point 116 or may allow a user to rotate the canister about the fulcrum 116.

In some instances, the biasing members 114 automatically lift (i.e., self-actuate) the canister 104 and rotate the canister 104 around the fulcrum point 116. For example, upon disengagement of the latch 112, the biasing members 114 may rotate the canister 90 degrees. In other instances, upon disengagement of the latch 112, the biasing members 114 may rotate the canister 104 some distance less than 90 degrees around the fulcrum point 116. In yet other instances, upon disengagement of the latch 112, the biasing members 114 rotate the canister some distance greater than 90 degrees around the fulcrum point 116. In some instances, the biasing members 114 may be configured to assist in rotating the canister 104 around the fulcrum point 116. For example, a user may need to apply additional rotational force to the canister 104 to rotate the canister around the fulcrum point 116. In other instances, the vacuum 100 does not include biasing members. For example, the vacuum 100 housing 102 may include a fulcrum point around which a user must rotate the canister 104 without biasing members.

Figure 14:
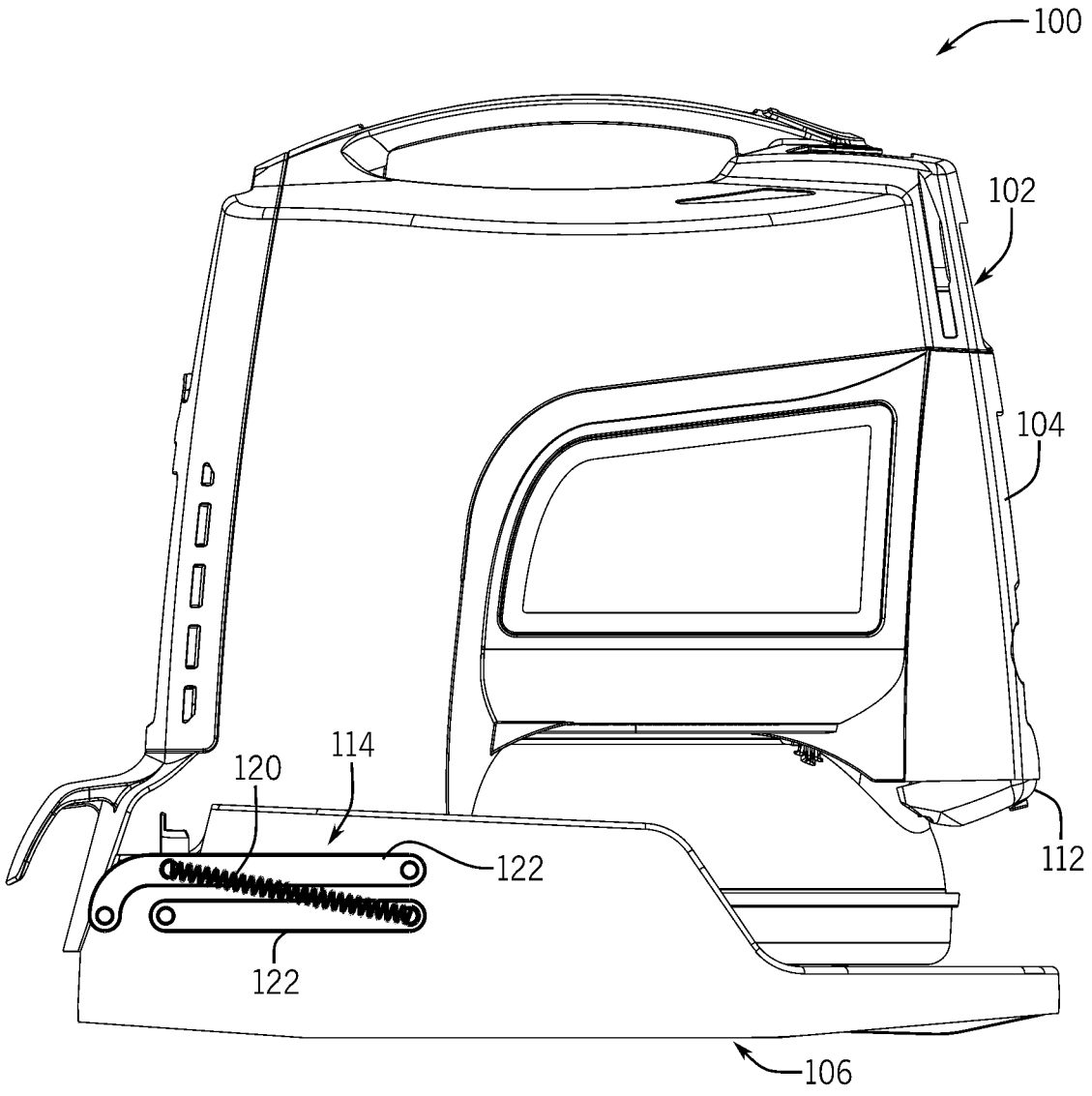
FIG. 14 is side view of the vacuum of FIG. 1 illustrating an implementation of the biasing member when the latch is in an engaged position.
Figure 15:
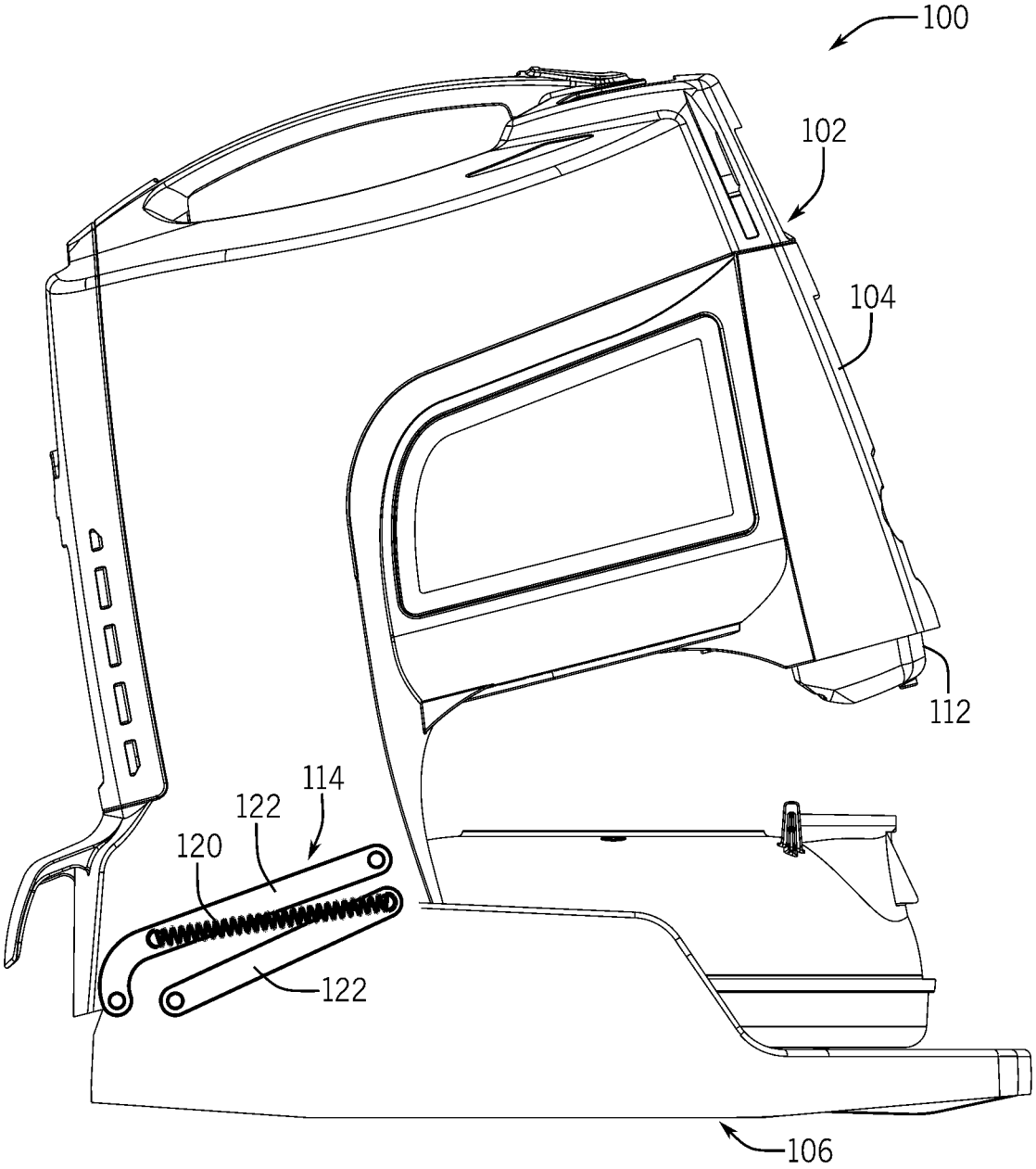
FIG. 15 is a side view of the vacuum of FIG. 14 illustrating an implementation of the biasing member when the latch is in a disengaged position.

In certain implementations, the biasing members 114 are tension springs 120 that are coupled to the opposing bars 122, as illustrated in FIGS. 14-15. In such implementations, one of the opposing bars 122 can be disposed on the water pan mount 106 and the other of the opposing bars 122 can be disposed on the housing 102 such that the tension spring 120 is operably coupled to each of the opposing bars 122 in an extended state when the latch 112 is engaged. After the latch 112 is disengaged, the tension spring 120 recoils and may begin to lift the housing 102 around the fulcrum point 116 or may allow a user to rotate the housing 102 about the fulcrum 116. In certain implementations, one set of the tension spring 120 and the opposing bars 122 can be disposed on each side of the vacuum 100.

Figure 16:
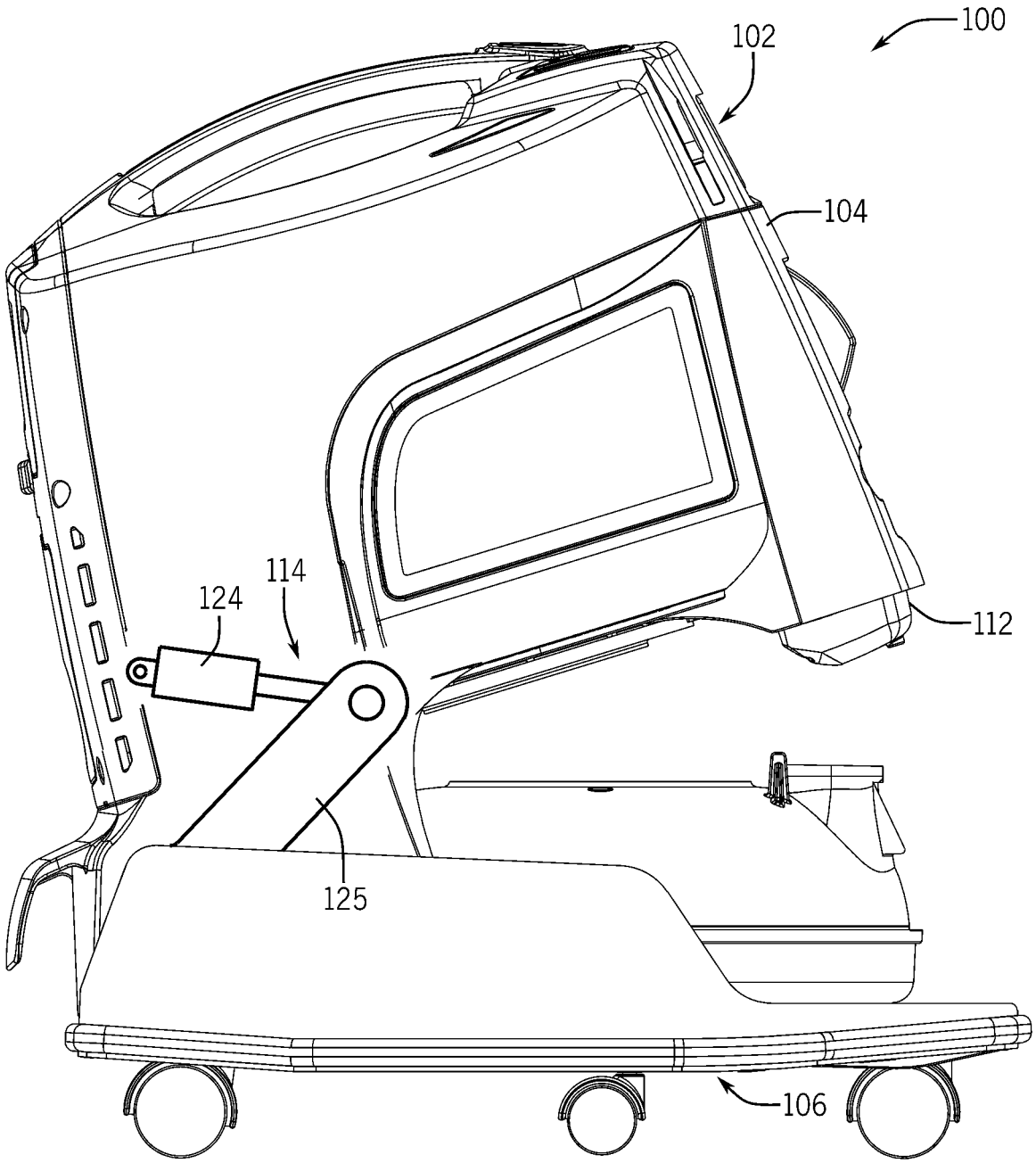
FIG. 16 is a side view of the vacuum of FIG. 1 illustrating an alternative implementation of the biasing member when the latch is in the disengaged position.

In certain implementations, the biasing members 114 are the gas spring 124 that is operably coupled to the strut 125, as illustrated in FIG. 16. In such implementations, the gas spring 124 can be coupled to the housing 102 and pivotally coupled to the strut 125, which can be coupled to the water pan mount 106. After the latch 112 is disengaged, the gas spring 124 may begin to rotate the housing 102 around the fulcrum point 116.

Figure 17:
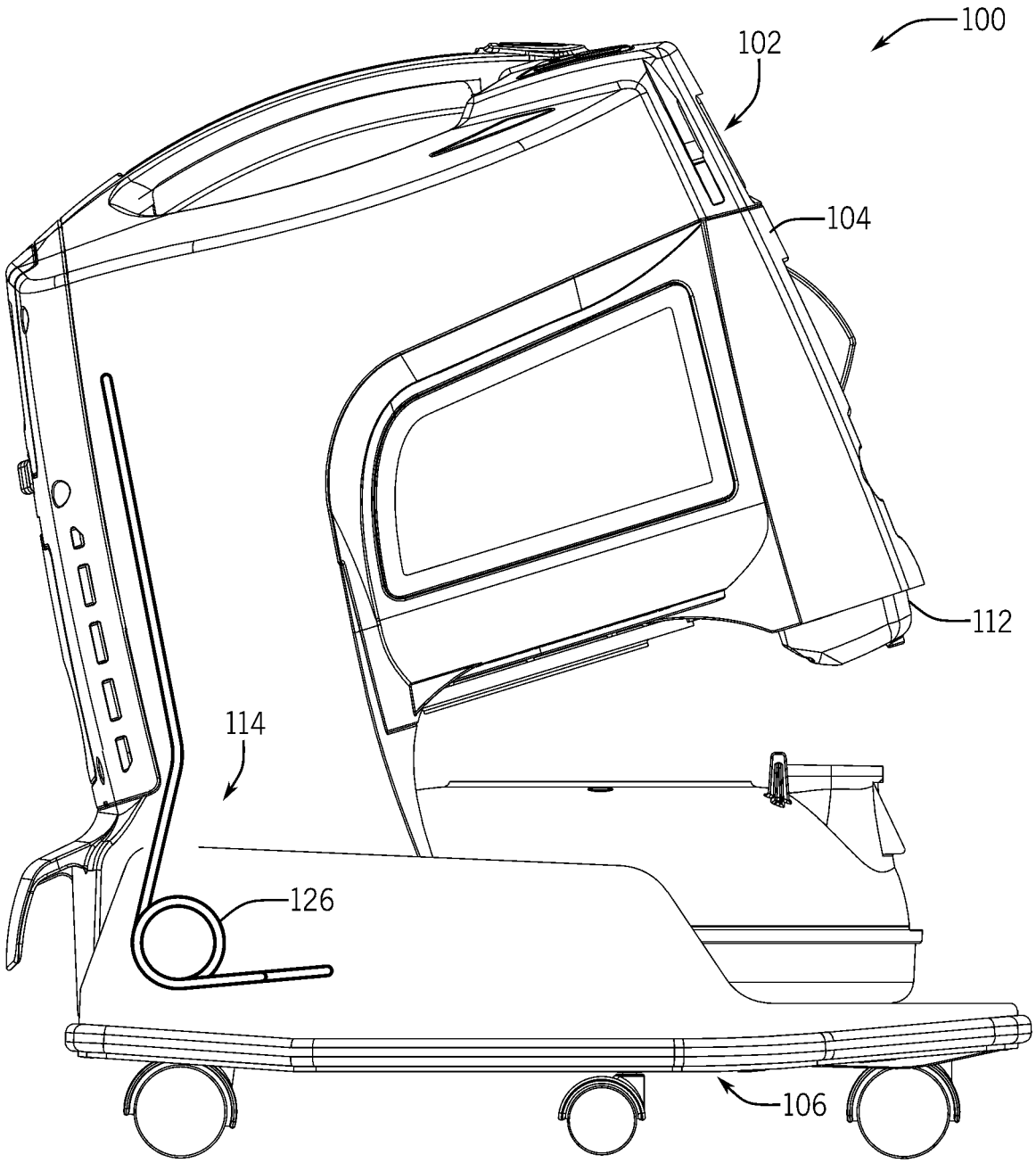
FIG. 17 is a side view of the vacuum of FIG. 1 illustrating another alternative implementation of the biasing member when the latch is in the disengaged position.

In certain implementations, the biasing members 114 are the torsion spring 126 operably coupled to the water pan mount 106 and the housing 102, as illustrated in FIG. 17. In such implementations, after the latch 112 is disengaged, the torsion spring 126 may begin to rotate the housing 102 around the fulcrum point 116.

In some embodiments, the canister 104 may be rotated opposite to the force of the biasing members 114 to engage the latch 112 of the housing. For example, the biasing members 114 may rotate the canister 104 around the fulcrum point 116 to an open position (e.g., as shown in FIG. 1). The water pan 108 may be placed within the water pan mount 106. The canister 104 may be rotated opposite the force of the biasing members 114 on the canister 104. The latch 112 may then be configured to engage with the housing 102 to secure the water pan 108 between the water pan mount 106 and the canister 104.

In some embodiments, as shown in FIG. 1, the vacuum 100 housing 102 includes a canister 104. In some instances, the canister 104 may include one or more sidewalls defining an internal volume. For example, the canister 104 may be a cylindrical shape with an internal volume (e.g., as shown in FIG. 1). In some instances, the canister 104 may be another shape, such as rectangular or pyramidal shape configured to create an internal volume. For example, the internal volume of canister 104 may provide a collection area for debris collected by the vacuum 100 during operation and/or storage for internal components configured to create a suction for the vacuum 100. The canister may include filters (e.g., high efficiency particulate air filters), a controller, a motor, and other components to facilitate the suction of particulates through a hose or other apparatus (not shown). In other instances, the canister may not include one or more filters.

In some embodiments, the vacuum 100 includes a water pan mount 106 coupled to the housing 102, with the water pan mount 106 being configured to receive a water pan 108. For example, the water pan mount 106 may be coupled to a fulcrum (not shown) attached to the canister 104 of housing 102. In other embodiments, the water pan mount 106 may be coupled to the housing 102 by another method, including a fastener or adhesive. In some instances, the water pan mount 106 may be configured to rotate around the fulcrum. For example, the housing 102 and the water pan mount 106 may be operably rotatable relative to one another. One benefit to operable rotation of the housing 102 and/or the water pan mount 106 is assisting with the process of completely detaching the housing 102 and/or canister 104 from the water pan mount 106 to remove the water pan 108.

In some embodiments, the water pan mount 106 is configured to receive the water pan 108. For example, the water pan 108 may be saucer-shaped, and the water pan mount 106 may be donut-shaped to receive the water pan 108. For example, the water pan mount 106 donut shape may have a smaller inner diameter of the apertural portion 110 than the diameter of the water pan 108. The apertural portion 110 sidewalls may be sloped towards the center of the water pan mount 106 to complement the shape of the water pan 108. For example, the water pan 108 may securely rest within the water pan mount 106 because of the complementary shapes. In other instances, the water pan 108 and water pan mount 106 may be other complementary shapes for the water pan 108 to selectively set within the water pan mount 106.

In some embodiments, the canister 104 and the water pan mount 106 of the housing 102 are configured to rotate around the fulcrum to secure the water pan 108. For example, the water pan mount 106 and the canister 104 may be coupled to a hinge around which the water pan mount 106 and the canister 104 rotate. In other instances, the fulcrum around which the water pan mount 106 and the canister 104 rotate is another type of rotary joint or swivel, such as one or more ball joints. In some instances, the fulcrum may be an axle. As used herein, the term "axle" refers to a rod or spindle (either fixed or rotating) to which the rotatable components are rotatably coupled.

In some embodiments, the vacuum 100 includes at least one latch 112 configured to prevent operable rotation of the housing 102 and water pan mount 106 around the fulcrum. For example, the at least one latch 112 may lock the housing 102 onto itself or onto another surface (i.e., the water pan mount 106 or canister 104) to prevent rotation around the fulcrum. For example, the at least one latch 112 may be selectively movable between, and positionable in, an engaged position (e.g., as shown in FIG. 4) and a disengaged position (e.g., as shown in FIG. 1), relative to the water pan mount 106 and housing 102. In some embodiments, the latch 112 is associated with the canister 104 and engages with the water pan mount 106. In other instances, the latch 112 engages with another portion of the housing 102 or the water pan 108. In some embodiments, the latch 112 is associated with the water pan mount 106 or water pan 108.

For example, the latch 112 may be a chin latch configured to engage between the canister 104 and another portion of the housing 102. In other instances, the latch 112 may be another type of mechanical latch to prevent rotation of the canister 104 and/or the water pan mount 106, including a sliding latch. In some instances, the latch 112 in the engaged position may prevent rotation of the housing 102, including the canister 104 and the water pan mount 106. One benefit in preventing rotation is the water pan 108 may be set within the water pan mount 106, and the engaged latch 112 may firmly secure the water pan 108 within the water pan mount 106. In other instances, the latch 112 may be in a disengaged position. For example, the latch 112 may be pushed, pulled, or moved in some way to disconnect from at least one surface of the housing 102. The disengaged latch 112 may then allow the canister 104 and the water pan mount 106 to operably rotate around the fulcrum, as described herein. In some instances, the latch 112 may engage the water pan mount 106 to secure the water pan 108.

Figure 3:
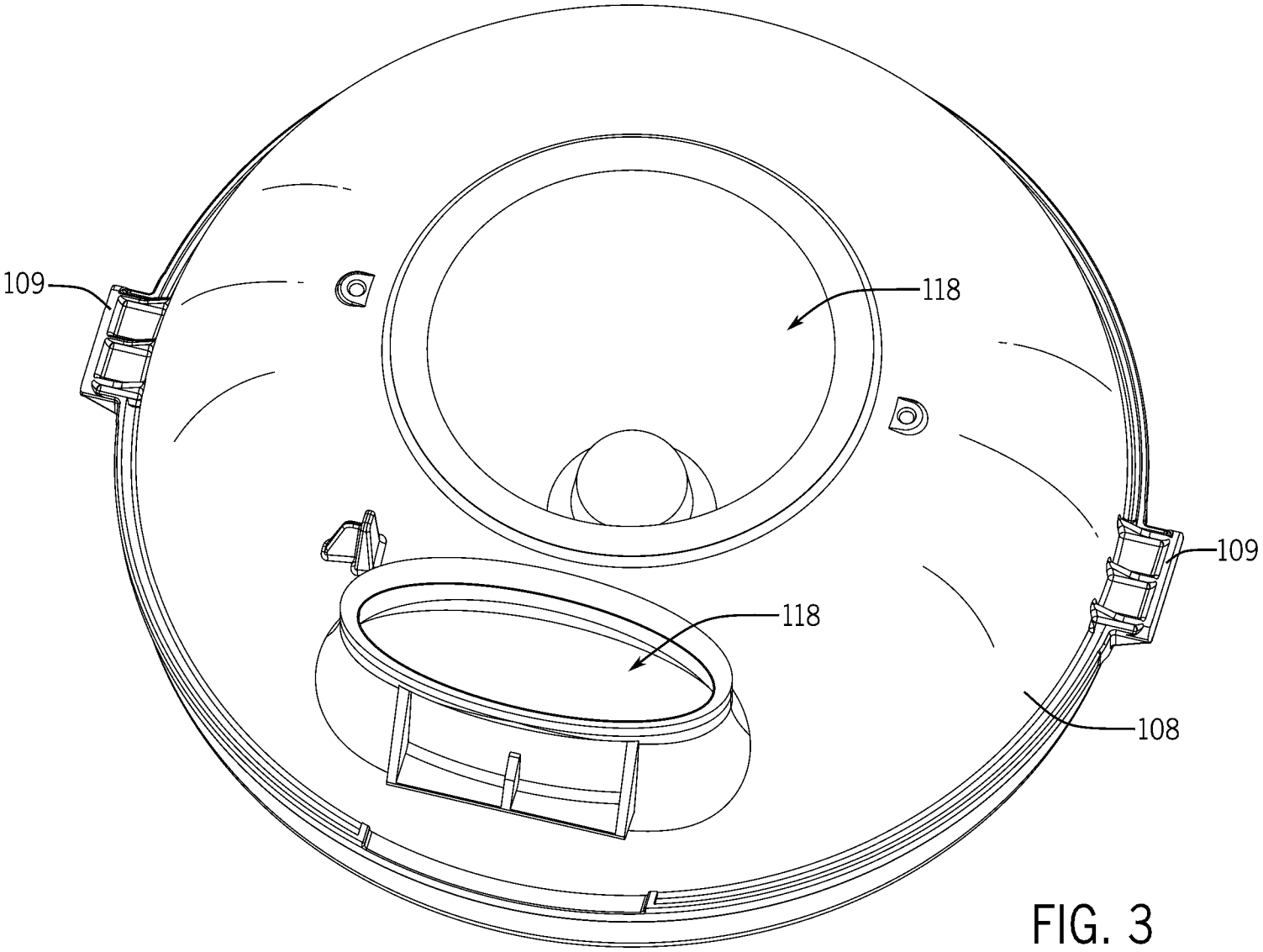
FIG. 3 is a perspective view of one embodiment of a water pan of the vacuum of FIG. 1.
Figure 4A:
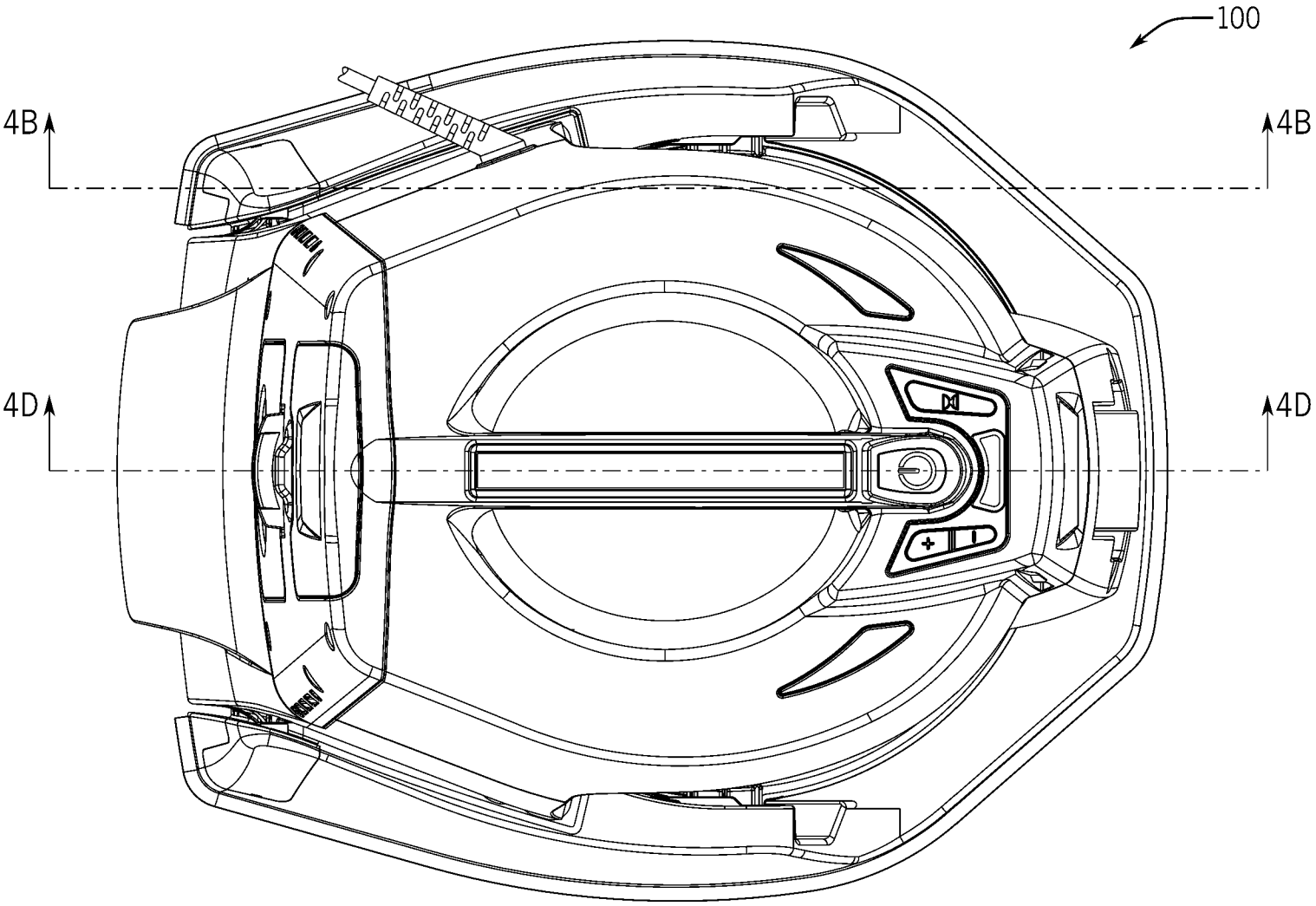
FIG. 4A is a top view of the vacuum of FIG. 1.
Figure 4B:
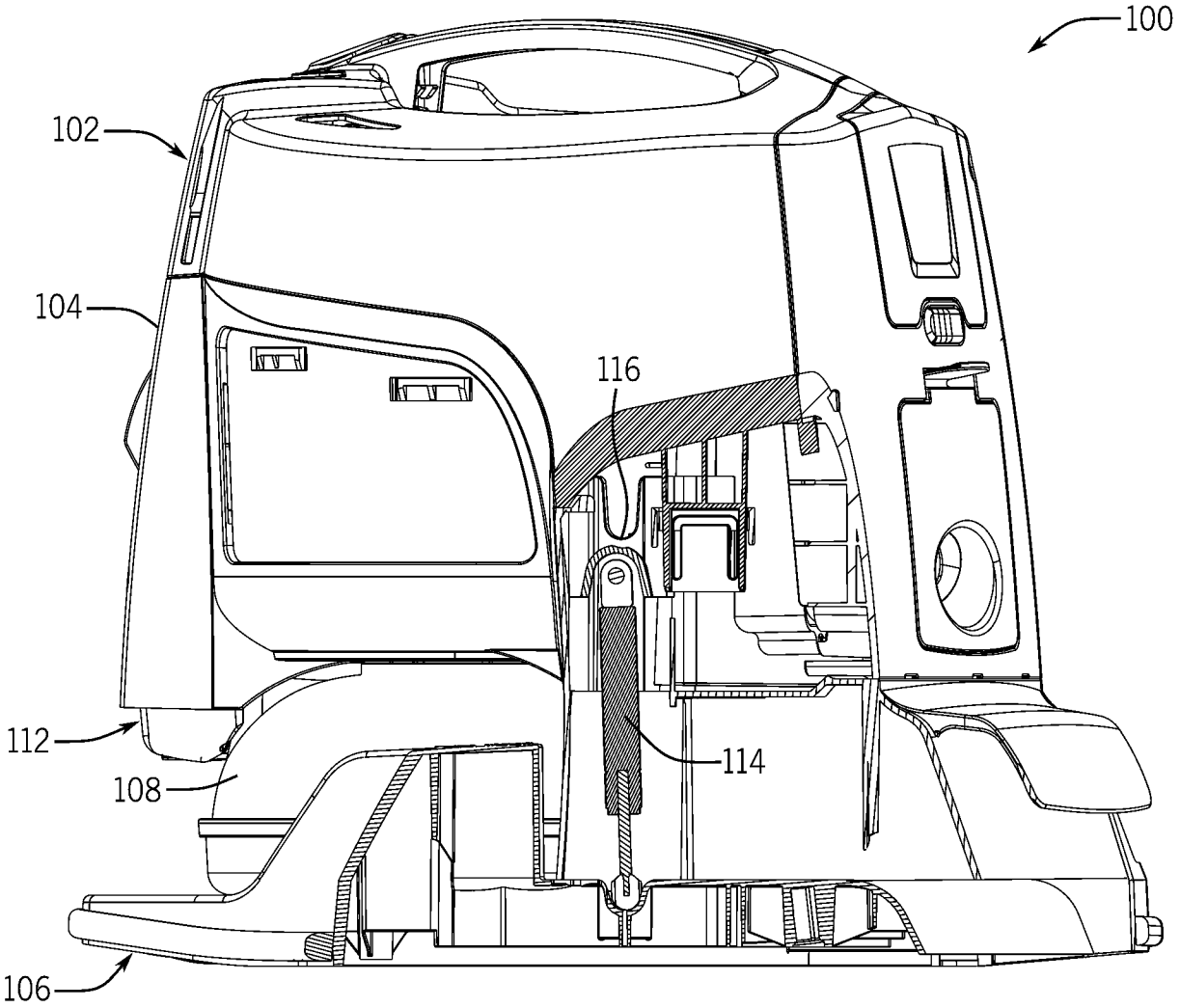
FIG. 4B is a partial cross-sectional view of the vacuum of FIG. 4A, taken along the line 4B-4B illustrating a latch in an engaged position.
Figure 4C:
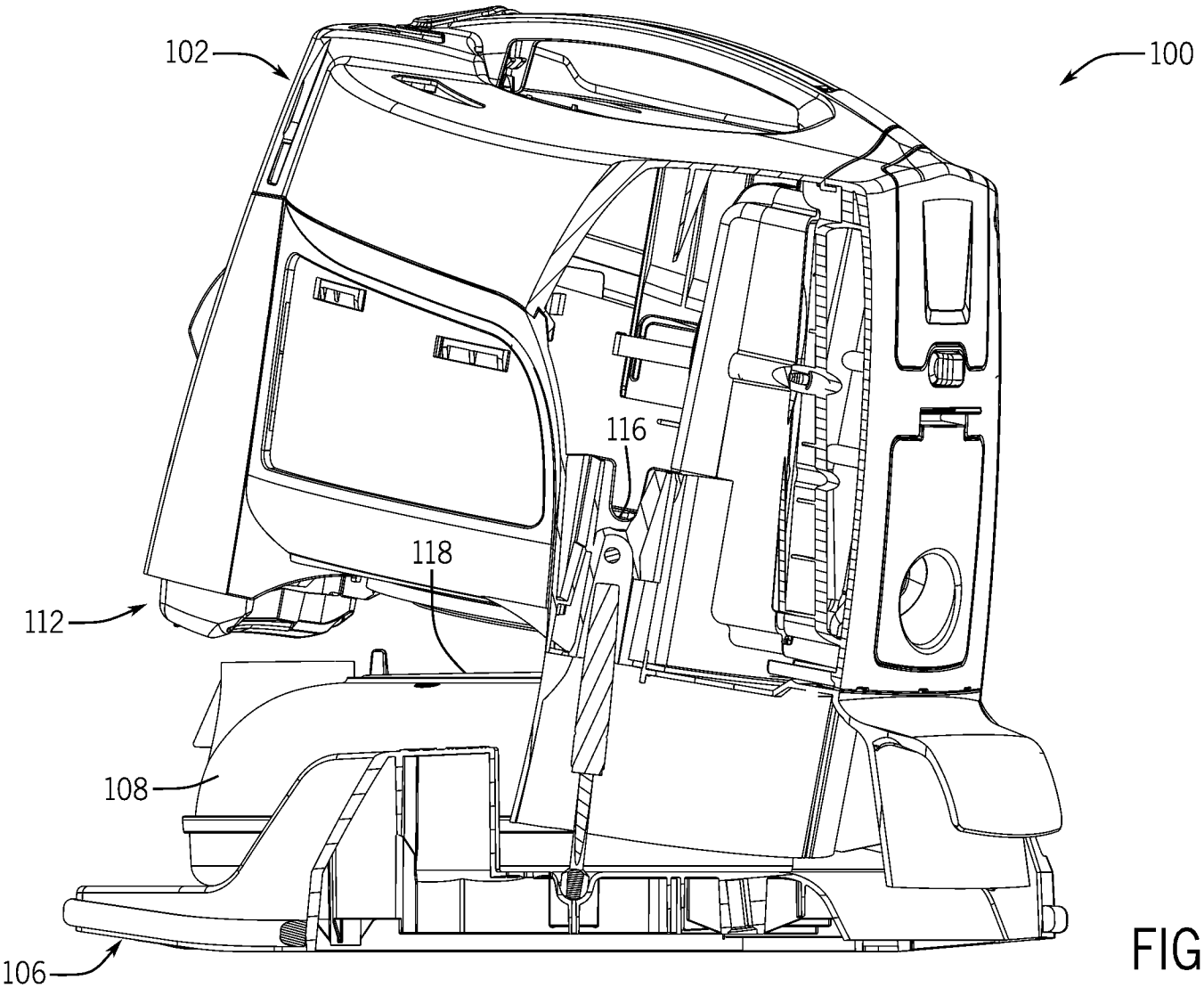
FIG. 4C is a partial cross-sectional view of the vacuum of FIG. 4A, taken along the line 4B-4B illustrating the latch in a disengaged position.
Figure 4D:
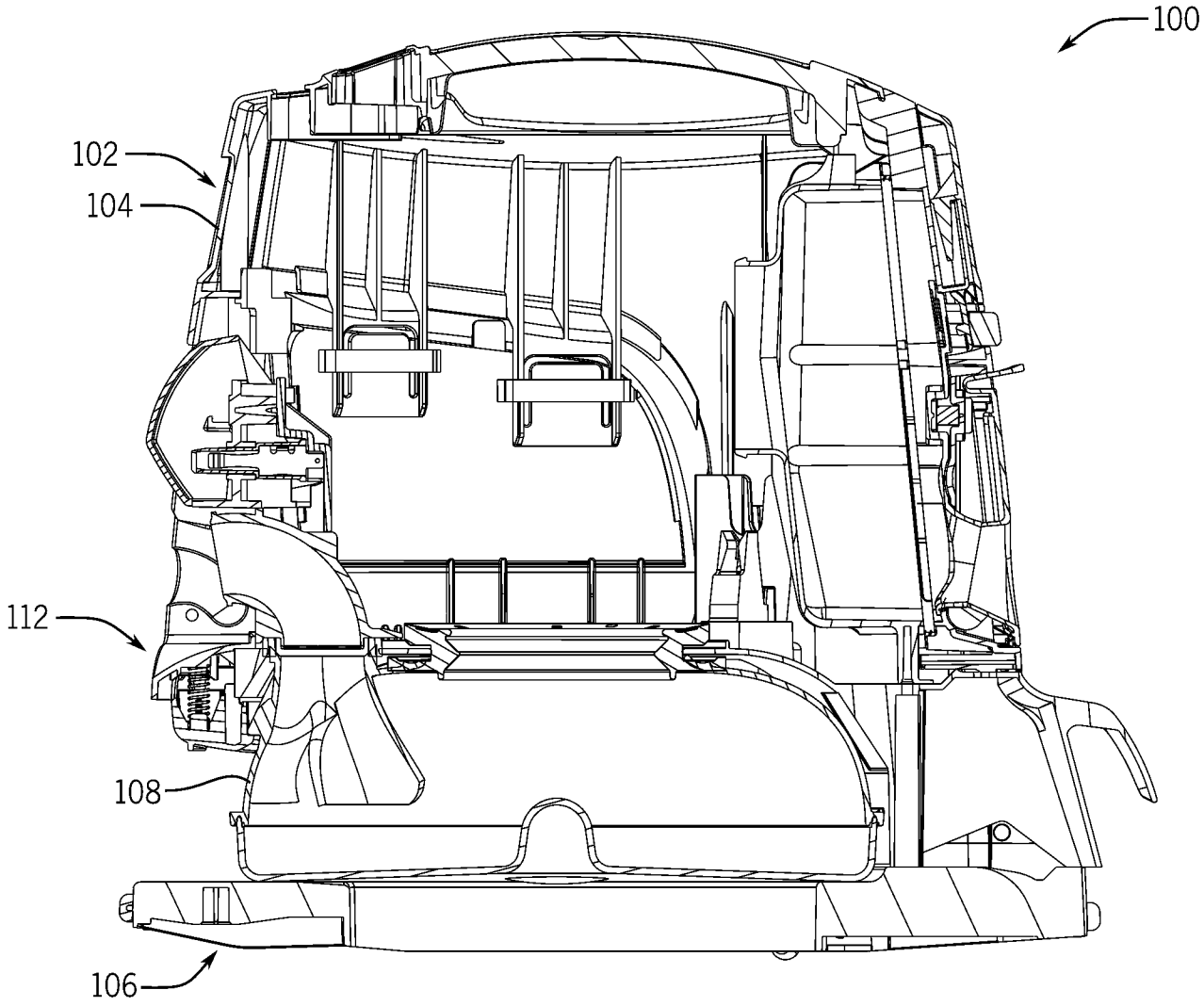
FIG. 4D is a cross-sectional view of the vacuum of FIG. 4A, taken along the line 4D-4D illustrating the latch in the engaged position.
Figure 4E:
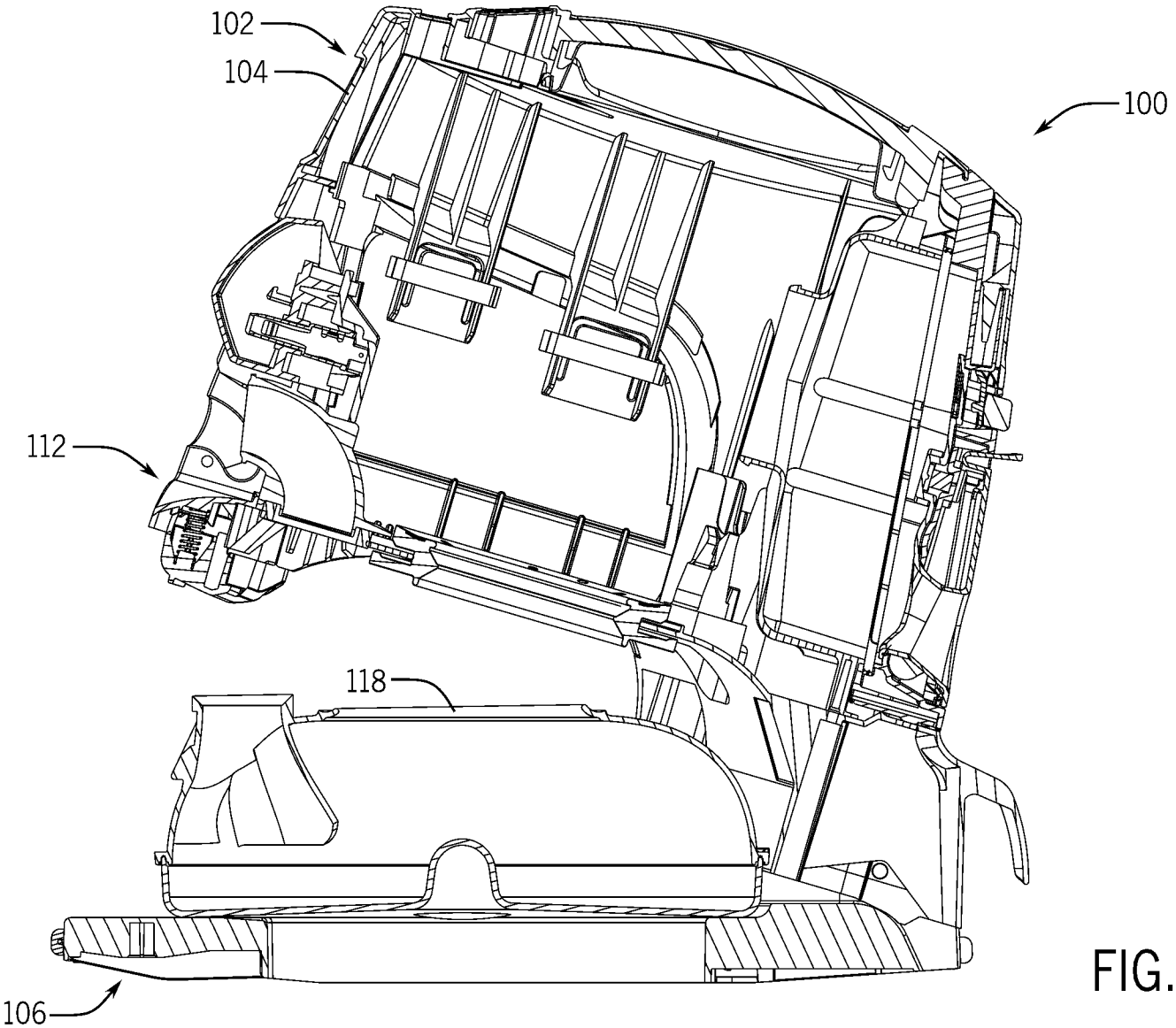
FIG. 4E is a cross-sectional view of the vacuum of FIG. 4A, taken along the line 4D-4D illustrating the latch in the disengaged position.

In some embodiments, as shown in FIG. 3, the water pan 108 includes a set of handles 109. The set of handles 109 may be configured to orient the water pan 108 within the water pan mount 106. For example, the handles 109 may be positioned within the water pan mount 106 to engage a bottom catch on the housing 102. In some instances, the canister 104 may rotate towards the water pan 108 and the latch 112 may attach to the front of the water pan 108. The canister 104 may also latch onto the handles 109. In this manner, the latch points between the canister 104 and the water pan 108 may create a water-tight seal for the water pan 108 apertures 118 described herein.

In some embodiments, the housing 102 and the water pan 108 include at least two apertures 118 configured to align to create a path for airflow. For example, the apertures 118 of the water pan 108 may be disposed on a top surface of the water pan and the apertures 118 of the housing 102 may be disposed on a surface opposed from the water pan mount 106. In some instances, once the one or more latches 112 are in an engaged position, the apertures 118 may align to create a path for airflow within the housing 102. For example, the airflow may be carried throughout the housing 102 created by the internal components of the canister 104 and any debris in the airflow may be caught by water contained by the water pan 108. In some instances, the water pan 108 and the housing 102 are operably engaged in an operating position when the apertures 118 are aligned. For example, setting the water pan 108 within the water pan mount 106 may align the apertures 118 of the water pan 108 and the housing 102 once the latch 112 is in an engaged position.

Wand Assemblies

Figure 5:
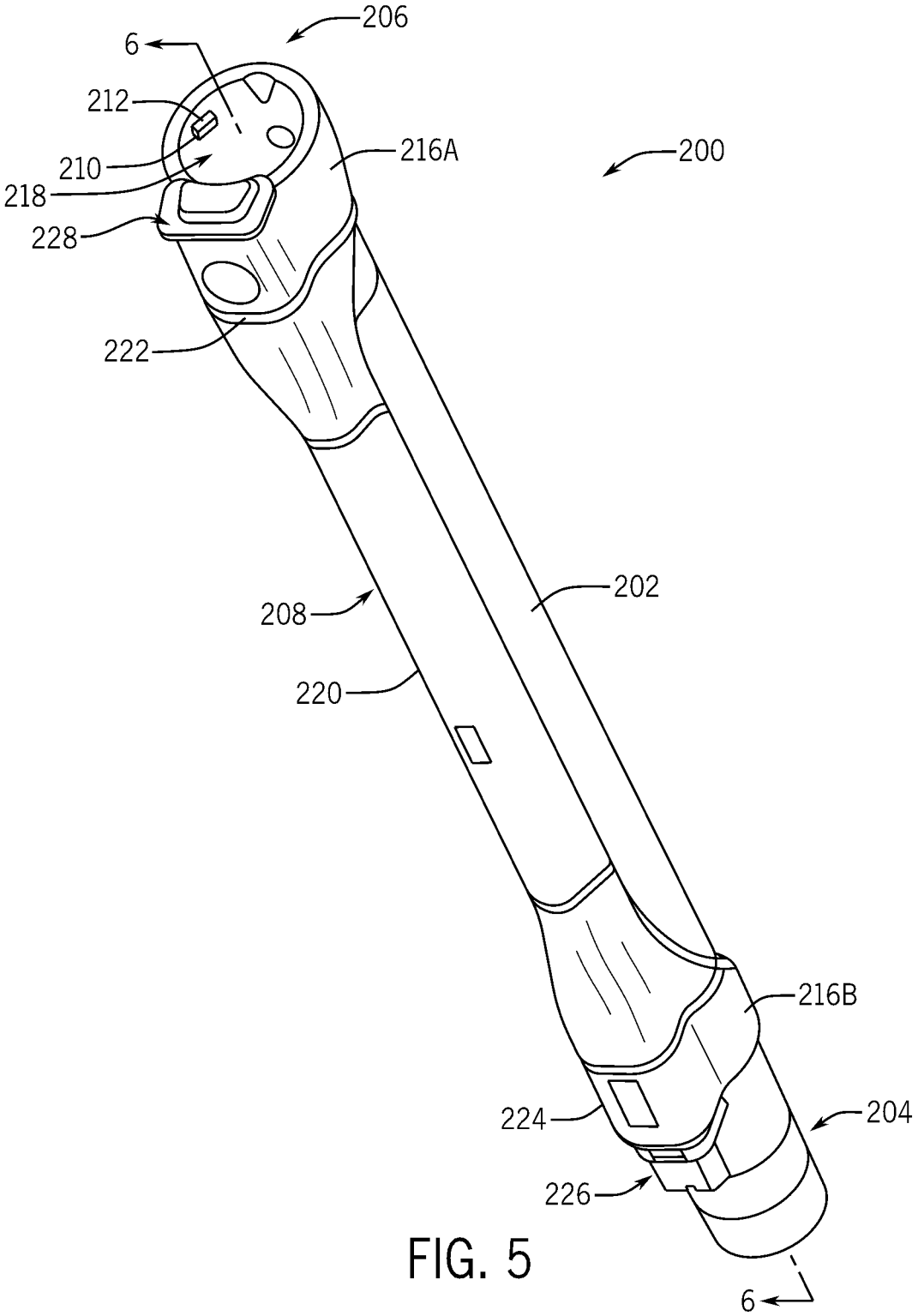
FIG. 5 is a perspective view of one embodiment of a vacuum cleaner wand assembly.

In some embodiments, as shown in FIG. 5, vacuum cleaner wand assembly includes a hollow wand. The hollow wand has a proximal end and a distal end, with the distal end being configured for operable attachment to a vacuum accessory. The vacuum cleaner wand assembly includes a sleeve selectively coupled to the wand as well as a cable. In some embodiments, the cable extends between the proximal end and the distal end of the wand. In some embodiments, the cable includes a male terminal and a female terminal configured for operable electrical connection to the vacuum accessory and/or the vacuum. The male terminal may include a pin terminal, a flat terminal, a slide electrical connector, straight blade plug, or other terminal type. The female terminal may include a receptacle barrel terminal, a blade receptacle terminal, straight blade connector, or some other terminal type. As described herein, the male terminal and female terminal may be disposed on opposed ends of the vacuum cleaner wand assembly. In some instances, the wand assembly may have one or more terminals on each end of the wand. In other instances, the male terminal and female terminal may be disposed on either end of the vacuum cleaner wand assembly.

In some embodiments, the vacuum cleaner wand assembly 200 includes a sleeve 208 and a cable contained within the sleeve 208. In some embodiments, the sleeve 208 and the cable are configured to establish electrical connection between a vacuum 250 (see FIG. 6B) and a vacuum accessory 252 (see FIG. 6B). For example, the vacuum may provide a power source that traverses across the cable to provide the electrical power to the vacuum accessory. For example, as discussed later, the vacuum accessory may mate with the distal end 204 of the sleeve 208 and the wand 202 to be powered by the aforementioned electrical connection. Vacuum cleaner accessories for operable connection via the wand assemblies may include any suitable accessories as known in the industry, including a power nozzle, an Aqua- Mate®, a RainJet®, a RainbowMate®, a MiniJet®, or a JetPad®, all commercially available from REXAIR.

In some embodiments, as shown in FIG. 5, the vacuum cleaner wand assembly 200 includes a hollow wand 202. In some embodiments, the hollow wand 202 may be a cylindrical hollow tube. In other embodiments, the hollow wand 202 may have another cross-sectional shape, such as rectangular, square, or triangular. Dirt, debris, and other particles may traverse the hollow tube from a distal end 204 to a proximate end 206. In some embodiments, the hollow wand 202 may be configured to receive and transfer dust and debris through an interior volume. For example, the hollow wand 202 distal end 204 may be configured to receive dirt through an aperture (not shown) to an interior volume. The dirt may travel through the interior volume to the proximate end 206 and be received by the vacuum (not shown). In some instances, the hollow wand 202 may be composed of a metal alloy. In other instances, the hollow wand 202 may be composed of some other material, such as a plastic material.

In some embodiments, the hollow wand 202 of the vacuum cleaner wand assembly 200 is associated with a sleeve 208. In some embodiments, the hollow wand 202 includes a series of apertures 210. The series of apertures 210 may be disposed on the proximate end 206 of the hollow wand 202. In some instances, the series of apertures 210 may be configured to receive a series of detents 212 disposed on the sleeve 208. For example, the series of detents 212 may be disposed on the interior of an apertural band 216A/216B of the sleeve 208. For example, the series of detents 212 may extend from the interior surface of the apertural band 216A/216B and operably snap into the series of apertures 210 of the hollow wand 202. In some instances, the apertural band 216A/216B and detent 212 maintains a seal around the inner surface 218 of the hollow wand 202. In some embodiments, as shown in FIG. 5, once the series of detents 212 snap into the series of apertures 210, the sleeve 208 is secured onto the hollow wand 202.

In some embodiments, the sleeve 208 includes an elongated neck 220, the first and second apertural bands 216A/216B, and a first cover 222 and a second cover 224. In some embodiments, a cable (not shown), a male terminal 226, and a female terminal 228 are disposed within the sleeve 208. For example, the sleeve 208 may be an overmolded plastic configured to secure and protect the terminals and cable within the sleeve 208. For example, as previously mentioned, the apertural bands 216A/216B may wrap or otherwise be positioned around the hollow wand 202 to secure the sleeve 208 onto the wand 202. In other instances, the apertural bands 216A/216B may secure the sleeve 208 onto the wand 202 some other method, such as tension, friction, or fasteners. In some embodiments, the hollow wand 202 may not include a sleeve 208. For example, the cable, male terminal 226, and female terminal 228 may be disposed or embedded within the hollow wand 202. In some instances, the various components may be disposed within the hollow wand 202 and secured by adhesive. In other instances, the various components may be embedded within an overmolded plastic formed in the inner surface 218 of the hollow wand 202.

The elongated neck 220 of the sleeve 208 may be disposed on one side to complement the shape of the hollow wand 202. In some instances, the elongated neck 220 may be hollow (not shown) and configured to store the electric cable between the terminals. In other instances, the elongated neck 220 may be molded onto the electrical wire to connect the terminals. The elongated neck 220 may extend from the proximate end 206 of the hollow wand 202 to the distal end 204. In some instances, the elongated neck 220 may partially extend along the hollow wand 202 or form another shape. For example, the elongated neck 220 may twist around the body of the hollow wand 202 from the proximate end 206 towards the distal end 204.

In some embodiments, the elongated neck 220 extends to a first cover 222 and a second cover 224. For example, the elongated neck 220 extends towards the proximate end 206 to widen into the first cover 222. For example, the elongated neck 220 may have a smaller area cross-section than the cross-sectional area of the first cover 222. In some instances, the elongated neck 220 may have a larger cross-sectional area than the first cover 222. In some embodiments, the elongated neck 220 extends to a distal end 204 to widen into the second cover 224. For example, the elongated neck 220 may have a smaller area cross-section than the cross-sectional area of the second cover 224. In some instances, the elongated neck 220 may have a larger cross-sectional area than the second cover 224. In some instances, the first cover 222 and the second cover 224 are configured to protect the later discussed male terminal 226 and female terminal 228. For example, the first cover 222 and the second cover 224 may be composed of plastic to protect the male terminal 226 and the female terminal 228 from the environment (i.e., wind, rain, and dirt). In some instances, the male terminal 226 and female terminal 228 may be interchangeable. In other instances, both terminals may be only male terminals or only female terminals.

In some embodiments, as shown in FIGS. 6-9, the vacuum cleaner wand assembly 200 includes a cable 230 configured to traverse between a male terminal 226 and a female terminal 228. In some embodiments, the cable 230 is configured for operable electrical connection to the aforementioned vacuum accessories via the terminals. As used herein, the term "about" refers to a range of +/−two percent of the unit of measurement stated thereafter. In some embodiments, the cable 230 is disposed within the sleeve 208. For example, the sleeve 208 may include an internal volume and the cable 230 rests within the internal volume. In some instances, the cable 230 may be within the hollow wand 202 or disposed elsewhere on the vacuum cleaner wand assembly 200, such as without a separate protective sleeve.

In some embodiments, the vacuum cleaner wand assembly 200 includes a male terminal 226 and a female terminal 228. In some embodiments, the male terminal 226 and the female terminal 228 are configured for operable electrical connection to the vacuum and vacuum accessory. For example, the male terminal 226 may include a series of pins 232 configured to be matingly inserted into a female end 256 (i.e., terminal) of the vacuum accessory 252. For example, the male terminal 226 may be inserted into the female end 256 of the vacuum accessory and snap into place, securing the vacuum cleaner wand assembly 200 to a desired accessory. For example, the male terminal 226 may include mating connectors such as detents, joints, blades, fasteners, or other mechanisms configured to secure the male terminal 226 to the accessory.

In some embodiments, the male terminal 226 is coupled to a biasing member 234 configured to eject male terminal 226. For example, the biasing member 234 may be compressed as the male terminal 226 attaches to the vacuum accessory. That is, the male terminal 226 moves relative to the sleeve 208 as the vacuum accessory slides attaches to the male terminal 226, thereby compressing the biasing member 234. In some instances, the male terminal 226 may selectively lock onto the button lock 236 as described herein. In this manner, the button lock 236 may hold the vacuum accessory and male terminal 226 together. That is, the button lock 236 and/or the biasing member 234 may be configured to hold in place the terminals as the attached accessory and vacuum are pushed and pulled by a user. In some instances, the male terminal 226 may actuate between an engaged and a disengaged position with the vacuum accessory, and the female terminal 228 may remain static when attaching to the vacuum. In other instances, the male terminal 226 and the female terminal 228 may both actuate, relative to the sleeve 208, between engaged and disengaged positions. In yet other instances, the male terminal 226 and female terminal 228 may both be static. The terminals may interchange between the type of terminal disposed at either end of the sleeve 208 as well as interchange their relative motion to the sleeve 208 for engaging the vacuum and vacuum accessories.

Figure 6A:
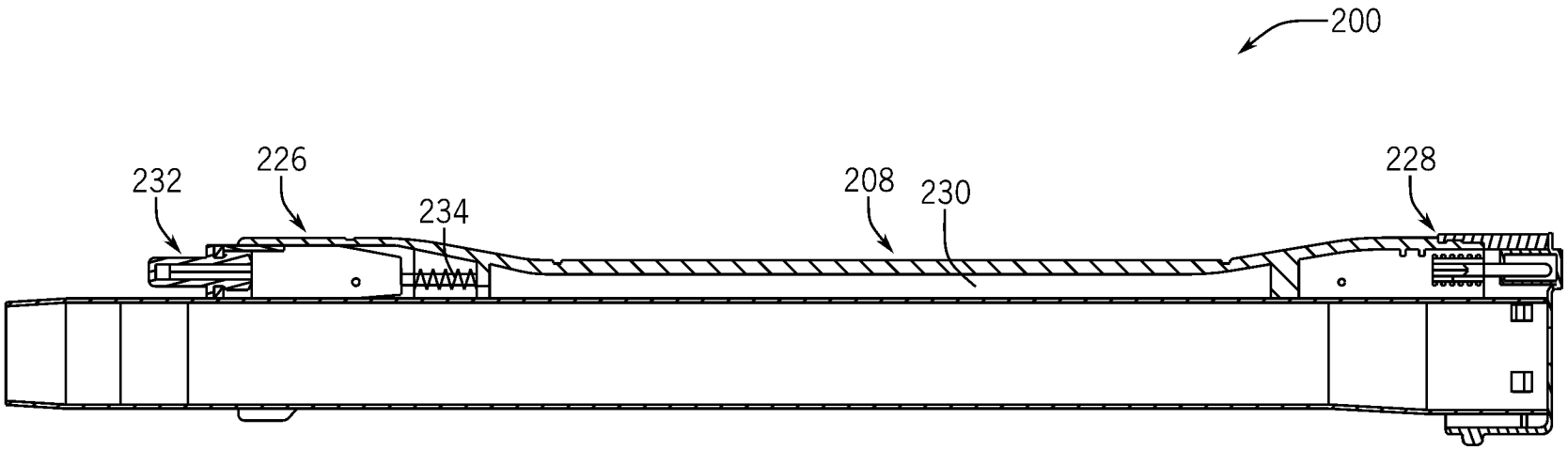
FIG. 6A is a side cross-sectional view of the vacuum cleaner wand assembly of FIG. 5.
Figure 6B:
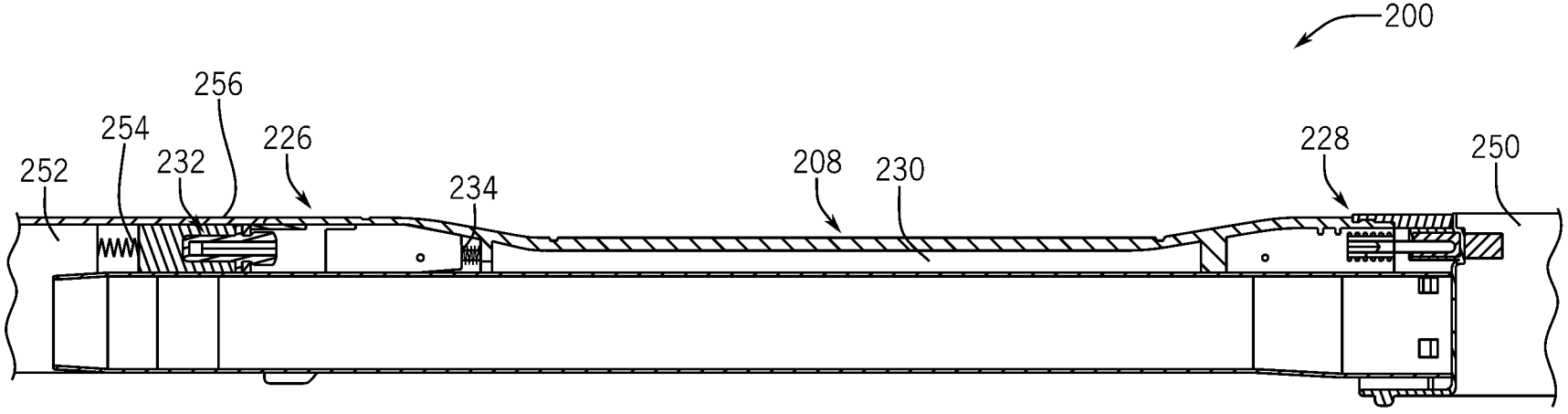
FIG. 6B is a side cross-sectional view of the vacuum cleaner wand assembly of FIG. 5 illustrating the vacuum cleaner wand assembly releasably coupled to a vacuum and a vacuum accessory.
Figure 6C:
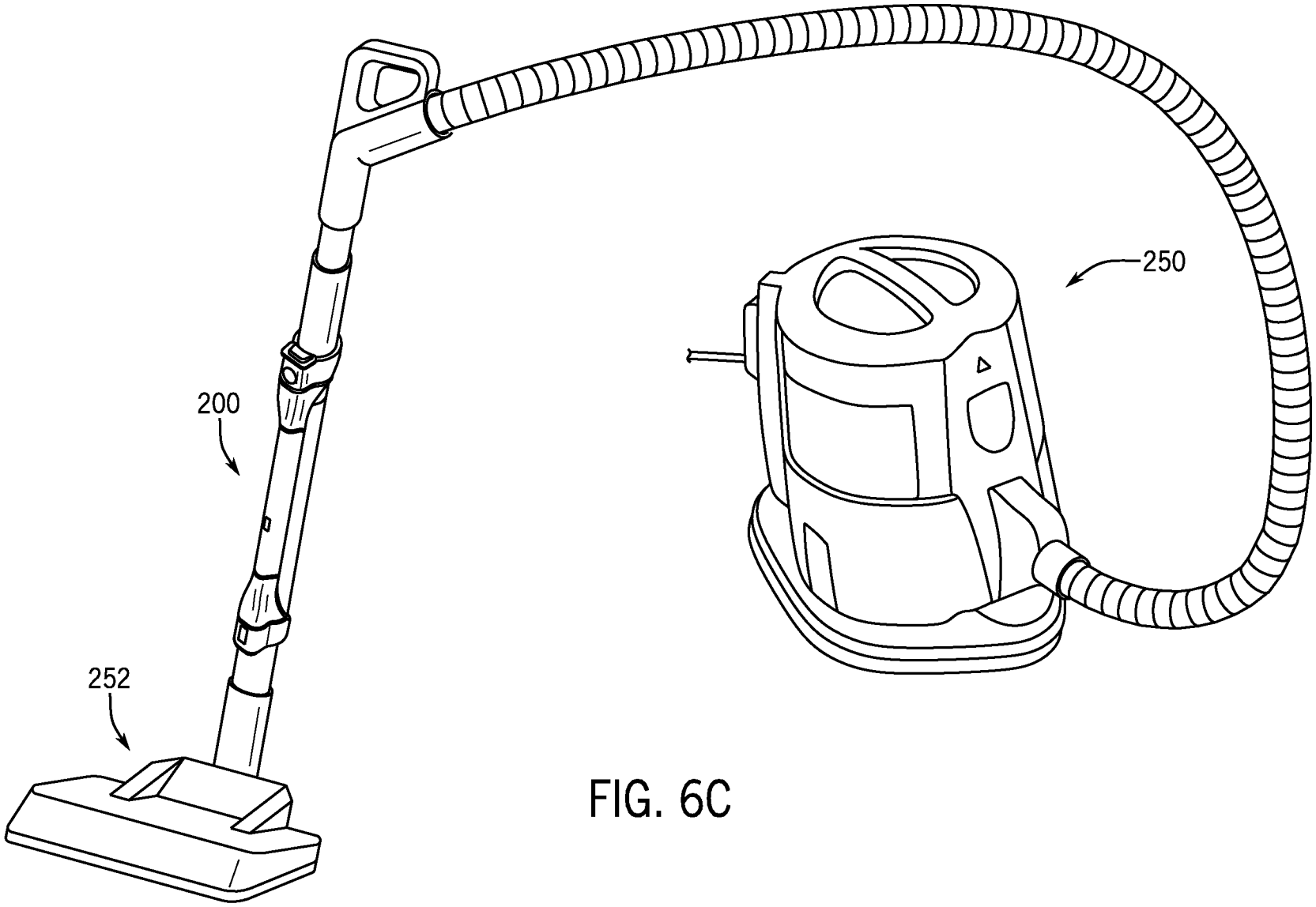
FIG. 6C is perspective view illustrating the vacuum cleaner wand assembly releasably coupled to a vacuum and a vacuum accessory.

In certain implementations, as illustrated in FIG. 6B, the female end 256 of the vacuum accessory 252 is coupled to another biasing member 254. For example, when the vacuum cleaner wand assembly 200 is releasably coupled to the vacuum accessory 252 the biasing member 254 is compressed within the vacuum accessory 252 while the biasing member 234 that is operably coupled to the male terminal 226 of the vacuum cleaner wand assembly 200 is also compressed. Although both the female end 256 of the vacuum accessory 252 and the male terminal 226 of the vacuum cleaner wand assembly 200 are coupled to respective biasing members 254, 234, it should be understood that, in certain other implementations, the female end 256 is not coupled to a biasing member while the male terminal 226 of the vacuum cleaner wand assembly 200 is coupled to a biasing member, and vice versa.

Figure 7:
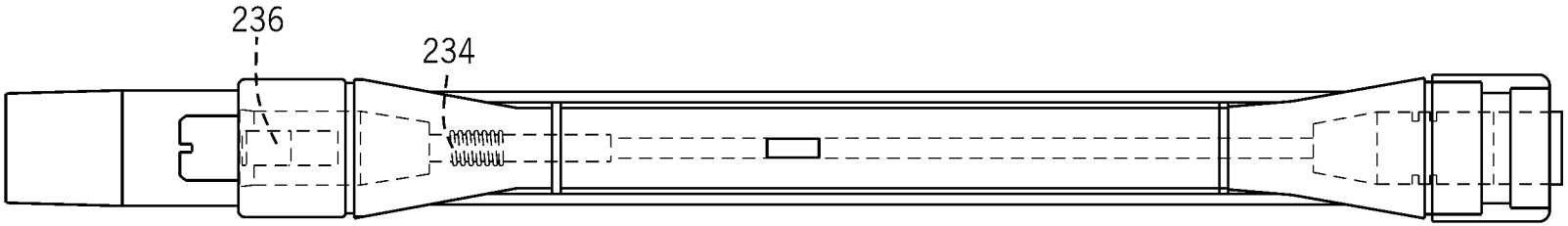
FIG. 7 is a top x-ray view of the vacuum cleaner wand assembly of FIG. 5.

In some embodiments, as shown in FIG. 7, a button lock 236 or another suitable interface is operable to engage and disengage the biasing member 234. For example, the button lock 236 may be configured to disengage the biasing member 234 and male terminal 226 from the vacuum accessory. The disengaged biasing member 234 may force the male terminal 226 to disengage the vacuum accessory. In some instances, the biasing member 234 may be preloaded within the sleeve 208. In this manner, the biasing member 234 removes any play with the male terminal 226. For example, when the vacuum cleaner wand assembly 200 is releasably coupled to the vacuum accessory 252, the biasing member 234 exerts force to maintain the male terminal 226 in electrical mating contact with the female end 256 of the vacuum accessory 252. The relative positions of the first terminal and the second terminal are maintained in mating electrical contact with each other, and refrain from sliding movement against each other, despite movement between the vacuum cleaner wand assembly 200 and the vacuum accessory 252 such as, for example, when the vacuum accessory 252 is being pushed and pulled during operation. One benefit of removing play with the biasing member 234 may include increasing the number of cycles the terminal for engaging and disengaging accessories and the vacuum with the wand. That is, the longevity of the wand terminals increase. In some instances, the biasing member 234 may be a compression spring. In other instances, the biasing member 234 may be a tension spring, a constant force spring, or an extension spring, among others.

Figure 8:
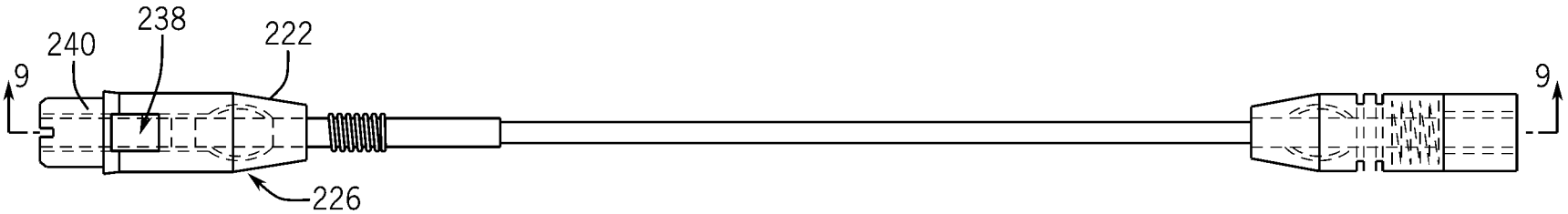
FIG. 8 is a top cross-sectional view of one embodiment of a sleeve of a vacuum cleaner wand assembly.
Figure 9:
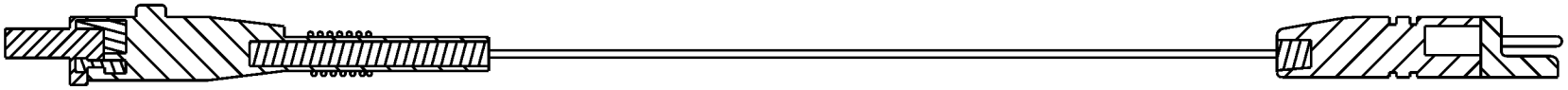
FIG. 9 is a side cross-sectional view of one embodiment of a sleeve of a vacuum cleaner wand assembly.
Figure 10A:
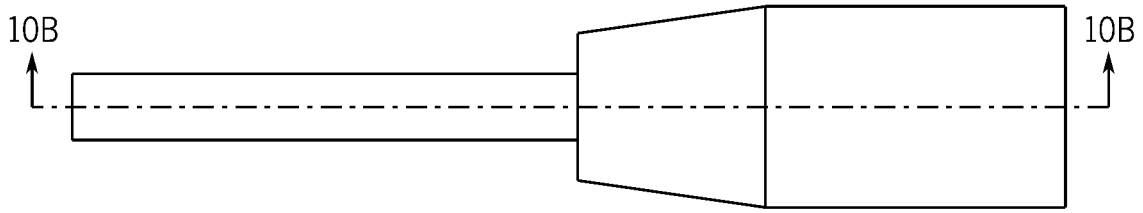
FIG. 10A is a top view of one embodiment of a receptacle body of a wand assembly.
Figure 10B:
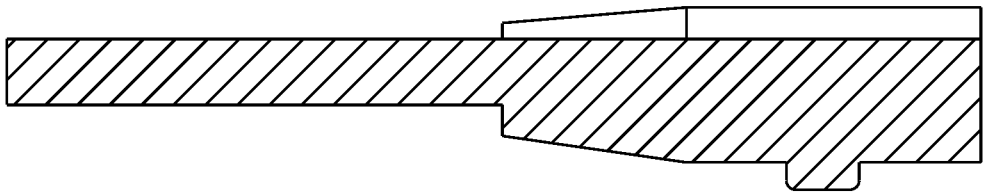
FIG. 10B is a cross-sectional view of the receptacle body of FIG. 10A.
Figure 11A:
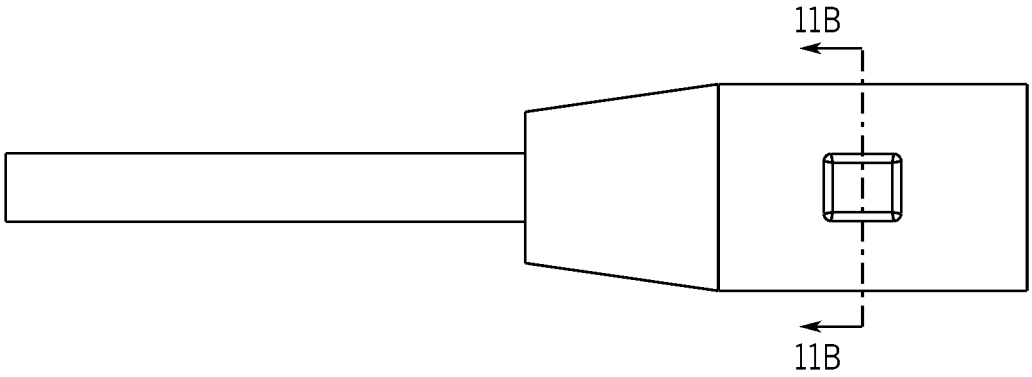
FIG. 11A is a top view of one embodiment of a cover of a wand assembly.
Figure 11B:
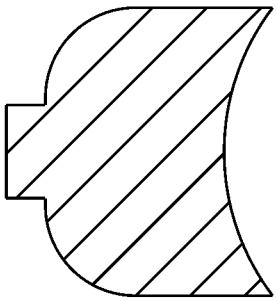
FIG. 11B is a cross-sectional view of the cover of FIG. 11A.
Figure 12:
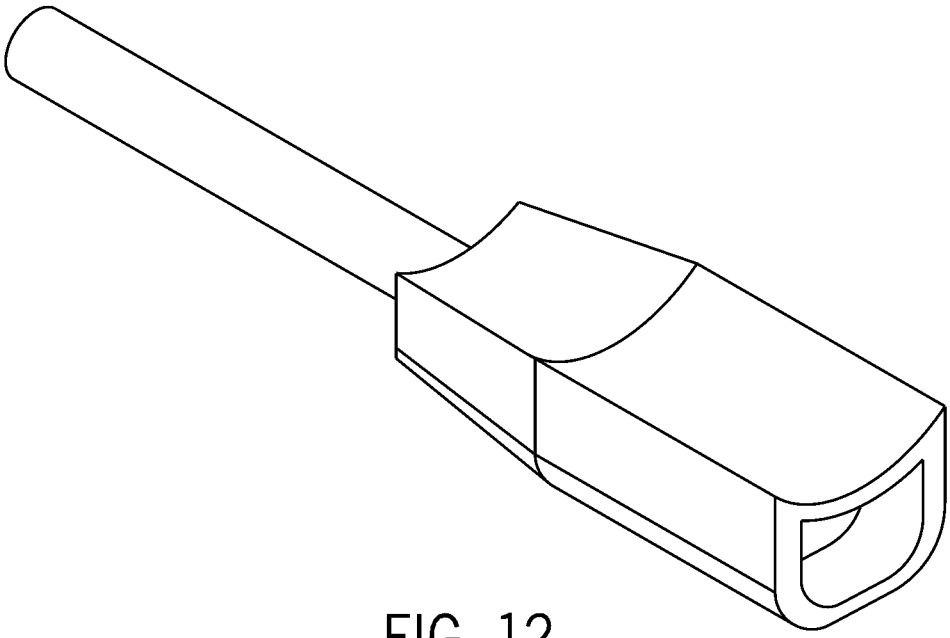
FIG. 12 is a bottom perspective view of the cover of FIG. 11A.
Figure 13:
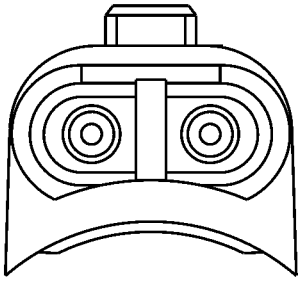
FIG. 13 is a front view of one embodiment of a female terminal of a wand assembly.

In some embodiments, the vacuum cleaner assembly 200 includes a female terminal 228 configured for operable electrical connection to a vacuum or other vacuum connection or accessory. In some embodiments, as shown in FIG. 8, the female terminal 228 may be disposed within a first cover 222 of the sleeve 208. For example, the first cover 222 may be configured to protect the female terminal from the environment surrounding the terminal. The female terminal may include an electrical receptor 238. For example, the electrical receptor 238 may be configured to receive an electrical connection from the vacuum. The electrical connection from the vacuum may vary in amperage and voltage. The electrical connection from the vacuum may be delivered via a pair of mating pins (not shown). For example, the female terminal 228 may include terminal ends 240 configured to receive the pair of mating pins from the vacuum. In some instances, the female terminal 228 may include a button lock (not shown) configured to operably engage and disengage mating pins from the vacuum. In other instances, the female terminal 228 may have a different mechanism operable to engage and disengage the vacuum electrical connection, such as a set of fasteners.

While the disclosure has been described with reference to a number of embodiments, it will be understood by those skilled in the art that the disclosure is not limited to such disclosed embodiments. Rather, the disclosed embodiments can be modified to incorporate any number of variations, alterations, substitutions, or equivalent arrangements not described herein, but which are commensurate with the scope of the disclosure.

What is claimed is:

1. A vacuum, comprising:

a housing comprising a canister with an internal volume;

a water pan mount coupled to the housing and configured to slidably receive a removable water pan, the removable water pan having at least one protrusion extending from a periphery of the removable water pan, the protrusion configured to cooperate with at least one channel disposed on an interior surface of the water pan mount, wherein substantially the entire housing is operably rotatable around a fulcrum, relative to the water pan mount, to secure the water pan within the housing; and at least one latch coupled to the housing, the at least one latch being operably positionable in an engaged position and in a disengaged position, wherein, in the engaged position, the at least one latch prevents rotation of the housing around the fulcrum and secure the removable water pan to the water pan mount.

2. The vacuum of claim 1, further comprising a series of biasing members coupled to the housing and the water pan mount, wherein the series of biasing members are configured to apply rotational force to the housing about the fulcrum.

3. The vacuum of claim 2, wherein the series of biasing members comprise one of at least two gas lift springs, a set of compression springs, a set of extension springs, a set of torsion springs, a set of tension springs wherein each tension spring is operably coupled to opposed bars, and a constant force spring.

4. The vacuum of claim 1, wherein the housing and the water pan each comprise at least two apertures configured to operably align to define a path for airflow.

5. The vacuum of claim 1, wherein the fulcrum comprises an axle.

6. The vacuum of claim 1, wherein the internal volume is further configured to contain additional vacuum components.

7. The vacuum of claim 1, wherein the at least one protrusion comprises a set of handles disposed on opposing sides of the water pan.

8. The vacuum of claim 1, wherein the at least one latch is coupled to the water pan in the engaged position.

9. The vacuum of claim 8, wherein the at least one latch is operably coupled to a catch disposed on a front of the water pan in the engaged position.

10. A vacuum, comprising:

a housing;

a water pan mount rotably coupled to the housing around a fulcrum, the water pan mount contoured to slidably receive a removable water pan, the removable water pan having at least one protrusion extending from a periphery of the removable water pan, the protrusion configured to cooperate with at least one channel disposed on an interior surface of the water pan mount;

at least two biasing members coupling the housing to the water pan mount, the at least two biasing members disposed on opposing sides of the vacuum and configured to apply rotational force to substantially the entire housing about the fulcrum, wherein the two biasing members define a maximum degree of rotation of the housing about the fulcrum; and at least one latch disposed on the housing, the at least one latch operably positionable in an engaged position and in a disengaged position, wherein, in the engaged position, the at least one latch prevents rotation of the housing with respect to the water pan mount.

11. The vacuum of claim 10, wherein, in the disengaged position, the housing is rotatable around the fulcrum.

12. The vacuum of claim 10, wherein the at least two biasing members are one of at least two gas lift springs, a set of compression springs, a set of extension springs, a set of torsion springs, a set of tension springs wherein each tension spring is operably coupled to opposed bars, and a constant force spring.

13. The vacuum of claim 10, wherein the housing comprises a canister comprising an internal volume configured to contain vacuum components.

14. The vacuum of claim 10, wherein the at least one protrusion comprises a set of handles disposed on opposing sides of the water pan.

15. The vacuum of claim 10, wherein the at least one latch is operably coupled to the water pan in the engaged position.

16. The vacuum of claim 10, wherein, in the engaged position, the at least one latch is coupled to the water pan mount.

17. The vacuum of claim 10, wherein the housing and the water pan each comprise at least two apertures configured to operably align to define a path for airflow.

18. The vacuum of claim 10, wherein the at least two biasing members are configured to apply rotational force to the housing about the fulcrum.

19. The vacuum of claim 4, wherein at least one of the apertures, configured for coupling to a vacuum hose, is disposed on an exterior front of the housing.

20. The vacuum of claim 17, wherein at least one of the apertures, configured for coupling to a vacuum hose, is disposed on an exterior front of the housing.

* * * * *